United States Patent [19]

Jackson

[11] 4,333,293

[45] Jun. 8, 1982

[54] JOIST HAVING DIFFERING METAL WEB REINFORCEMENT

[75] Inventor: Edgar D. Jackson, Victorville, Calif.

[73] Assignee: Steel Web Corporation, Alta Loma, Calif.

[21] Appl. No.: 151,158

[22] Filed: May 19, 1980

[51] Int. Cl.[3] ..... E04C 3/292

[52] U.S. Cl. ..... 52/692; 52/693

[58] Field of Search ..... 52/693, 694, 692

[56] References Cited

U.S. PATENT DOCUMENTS

| | | | |
|---|---|---|---|
| 146,114 | 12/1873 | Weimer | 52/639 |
| 1,663,487 | 3/1928 | Smith et al. . | |
| 3,345,792 | 10/1967 | Chandler | 52/648 |
| 3,531,904 | 10/1970 | Sanford | 52/693 X |
| 3,748,809 | 7/1973 | Jackson | 52/693 X |
| 3,875,650 | 4/1975 | Jackson | 52/693 X |
| 3,910,001 | 10/1975 | Jackson | 52/281 |
| 3,925,951 | 12/1975 | Jackson et al. | 52/693 |
| 4,016,698 | 4/1977 | Rogers | 52/693 X |
| 4,274,241 | 6/1981 | Lindal | 52/693 X |

FOREIGN PATENT DOCUMENTS

| | | | |
|---|---|---|---|
| 1286122 | 8/1972 | United Kingdom | 52/694 |

*Primary Examiner*—Alfred C. Perham

*Attorney, Agent, or Firm*—William W. Haefliger

[57] ABSTRACT

A truss incorporates metallic webs of differing gages, and in protected positions between chord members, to enable its use as a floor joist.

12 Claims, 6 Drawing Figures

JOIST HAVING DIFFERING METAL WEB REINFORCEMENT

BACKGROUND OF THE INVENTION

This invention relates generally to the construction of lightweight trusses adapted for use in commercial and residential environments. More specifically, the invention concerns simplifications and economies in the construction and fabrication of such trusses particularly useful as floor joists.

Prior to this invention, trusses and trussed joists of the type referred to were constructed of all wooden members, or with diagonal metallic webs of different lengths interconnecting non-parallel upper and lower members. See for example U.S. Pat. No. 3,748,809.

No way was known to construct a less expensive yet satisfactorily sturdy truss using metallic diagonal webs of equal length, to achieve economies and simplifications in truss construction, and in the manner to be described.

SUMMARY OF THE INVENTION

It has been found that an extremely lightweight and easily fabricated truss, useful as a floor joist, may be formed by interconnecting parallel upper and lower chord members with equal length metallic webs of differing thickness, or gage. Basically, the truss comprises (a) upper and lower longitudinally extending generally parallel chord members which are vertically spaced apart, (c) multiple upright blocks which are longitudinally spaced apart along the length of said chord members and located therebetween, said blocks interconnecting the chord members, (c) and multiple load carrying metallic webs in spaces between the blocks, each web having flat ends, one of which is located between the upper end of a block and the lower side of the upper chord member, and the other of which is located between the lower end of another block and the upper side of the lower chord member, said other end located closer to the center of the truss than said one end, (d) successive webs in a direction away from the center of the truss having increasing thickness.

As will be seen, the metallic webs may typically have angled main extents between their opposite ends; the interconnection of the web ends and chords may be quickly accomplished by driving nails through the chords and web flat ends and then into the ends of the blocks, which may consist of wood; and the approximately equal length steel webs may, successively, have thicknesses which increase by about 2 gage in directions away from the center of the truss. Further, strength of the truss is optimized, while the webs remain protectively confined between the chord members, by increasing the overall width of each web main extent to bear a ratio to the chord width which lies between 0.75 and 1.00. In this manner, an extremely lightweight truss is achieved, with maximum strength; the chord members and certain blocks may comprise wooden two by fours; equal length webs and equal distance separation of the blocks may be employed; and rapid fabrication achieved. If desired, a strength increasing metallic strip may be protectively attached to the lower chord member, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 1:
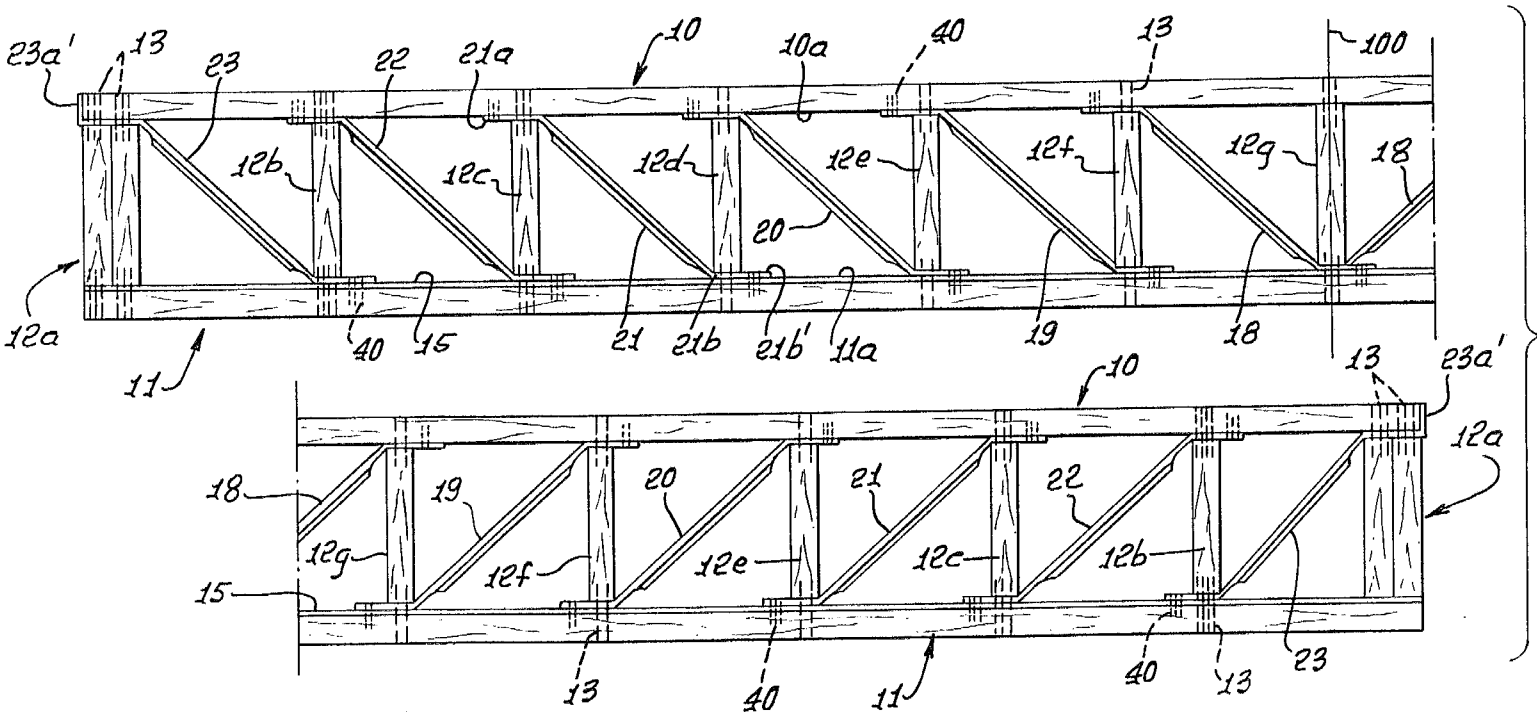
FIG. 1 is a side elevation of a truss incorporating the invention.

FIG. 1 shows upper and lower longitudinally elongated chord members 10 and 11 extending in the same generally horizontal direction and spaced apart vertically. Such members are typically parallel, may advantageously consist of wood, and they have inner sides at 10*a* and 11*a*. They may for example comprise wooden two by fours.

Means is provided to interconnect the members 10 and 11, such means typically including non-metallic (as for example wooden) upright blocks 12*a*–12*g* which are longitudinally spaced apart and located between members 10 and 11. The vertical dimensions of the blocks are typically equal; however the end wooden blocks 12*a* typically comprise two side-by-side two-by-fours, whereas blocks 12*b*–12*g* comprise single wooden two-by-fours. Fasteners such as nails 13 connect the chords to the ends of the blocks, as represented in FIG. 1 and in the FIG. 6 nailing detail. In addition, blocks 12*a* to 12*g* may be glued to the upper chord members inner side 10*a* and to a metallic strap 15 extending flatly along the inner side 11*a* of the lower chord member. Strip 15 may be glued to side 11*a;* it may have 22 gage, and it has width about the same as that of the lower chord member. (See FIG. 2). Nails 13 project through the reinforcement strip 15, as shown.

Figure 5:
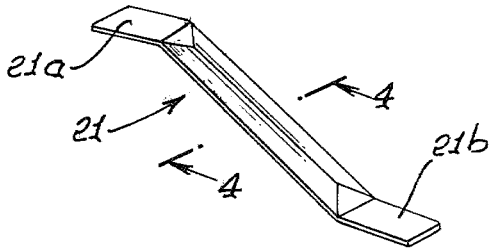
FIG. 5 is a perspective view of a metallic web as employed in the truss of FIGS. 1 and 2.

The upper and lower chord members and blocks are also interconnected by multiple load carrying metallic webs 18–23 located in the spaces between the blocks, such webs extending diagonally between the chord members, as shown. Each web has flat ends, as at 21*a* and 21*b*, in FIG. 5, one of which (21*a*, for example) is located between the upper end of a block (see block 12*c*, for example) and the lower side 10*a* of the upper chord member; and the other end (21*b* for example) is located between the lower end of another block (block 12*d* for example) and the upper side 11*a* of the reinforcement strap 15. In each case, the web lower or other end is located closer to the center 100 of the truss than the web upper or one end, as referred to.

Further, it will be noted the successive webs in a direction away from the center of the truss have increasing thickness (i.e. decreasing gage). In the example, web 19 has 26 gage; web 20 has 24 gage; web 21 has 20 gage; web 22 has 18 gage and web 23 has 16 gage. Web 18 has 26 gage, as shown.

Figure 4:
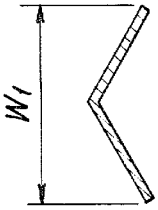
FIG. 4 is an enlarged section on lines 4—4 of FIG. 5.

This construction enables the webs to be alike in length and width, which enables the like blocks to be spaced apart longitudinally at equal intervals, while at the same time the strength of the truss increases, outwardly or away from center 100. FIG. 4 shows the webs to have angled cross sections throughout their main extents, between the flat ends.

More specifically, the overall width $W_1$ of each web is the same as or only slightly less than the overall width $W_2$ of each chord member. Thus, for example, the ratio $W_1/W_2$ is between $\frac{3}{4}$ and 1, and preferably is about $\frac{7}{8}$. As an example, if the chord members consist of two-by-fours, their widths are about $3\frac{1}{2}$ inches, and the overall width of each web is about $3\frac{3}{8}$ inches. Again, uniformity of spacing of the blocks and webs is thereby enabled, while the webs are protectively located between the chord members, and at the same time the truss strength increases in an outward direction.

Figure 3:
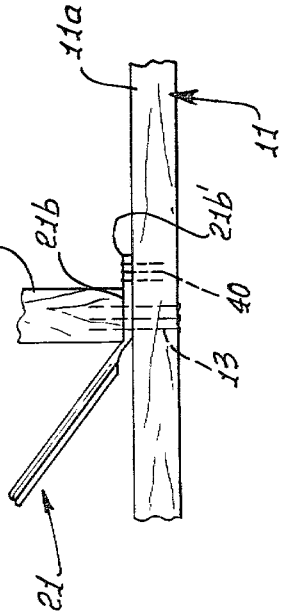
FIG. 3 is a fragmentary elevation showing a modified construction.

In FIG. 3, the flat metallic strap is omitted adjacent the side 11*a* of chord member 11.

Figure 2:
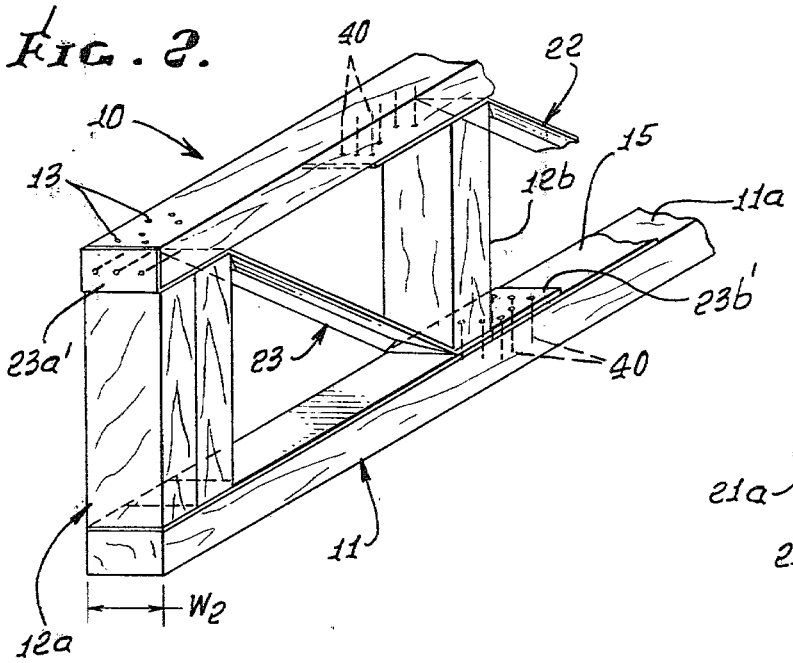
FIG. 2 is a perspective view of a portion of the FIG. 1 truss.
Figure 6:
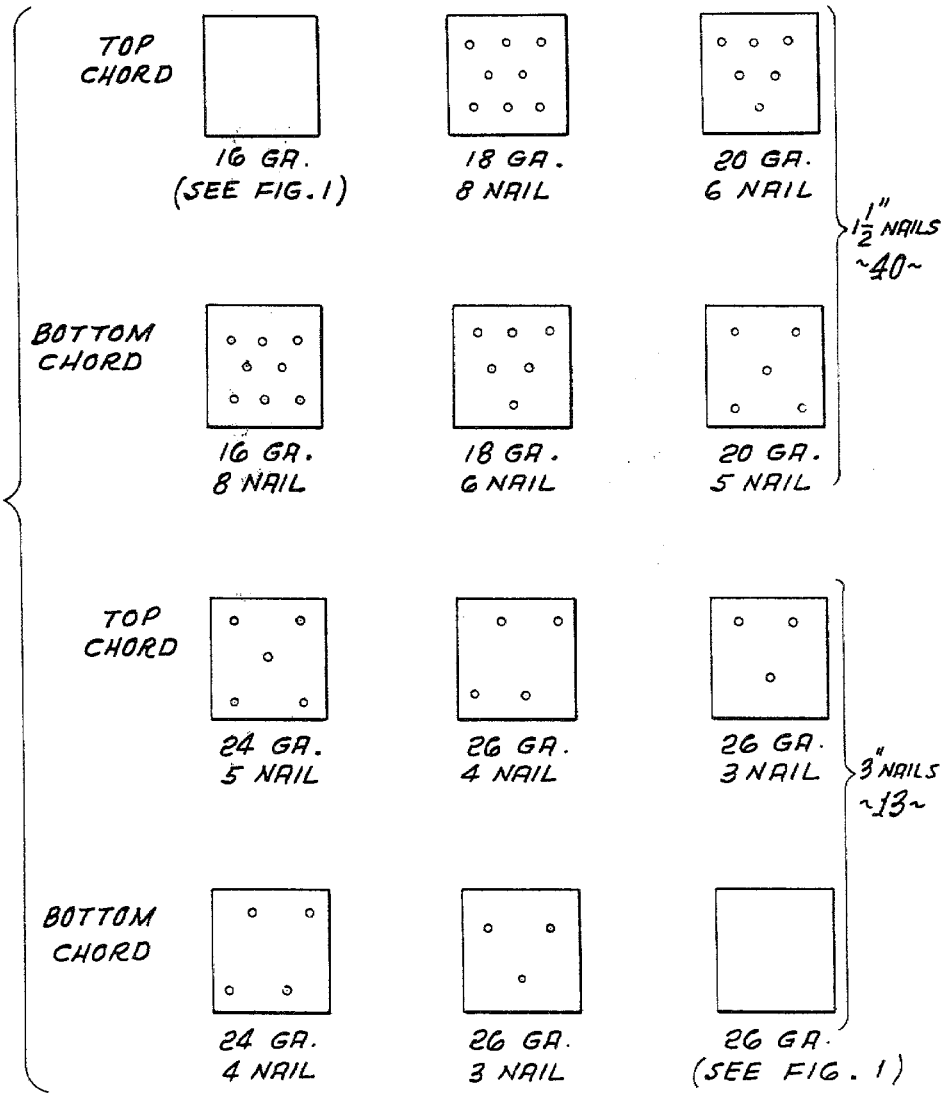
FIG. 6 shows nailing details.

In FIGS. 1–3, the blocks 12*a* comprise two side-by-side wooden two-by-fours, and the blocks 12*b*–12*g* may comprise wooden two-by-fours. Note that the flat ends of the webs, as at 21*a* and 21*b*, extend beyond the ends of the blocks; see for example overhang 21*b*′ in FIG. 3. Finally, FIGS. 1 and 6 show that increasingly more nails are employed to connect the chords and blocks, in direction toward the ends of the truss.

In the above, the chord members may be spliced, if desired. Also, as seen in FIG. 2, the end portion 23*a*′ of the flat end 23*a* of web 23 is folded up and nailed to the end of the upper chord member 10. FIG. 2 additionally shows shorter nails at 40 extending through the web flatened portion 23*b*′ that projects beyond block 12*b*. It will be seen that each web has a similar flatened portion that projects beyond its associated block, and that short inserts (as for example $1\frac{1}{2}$″ nails) project therethrough and into the adjacent chord member. FIG. 6 shows the nailing details with numbers (3–8) in squares also referenced in FIG. 1. Accordingly, extreme strength is achieved, together with ease of fabrication.

I claim:

1. In a truss, the combination comprises (a) upper and lower longitudinally extending generally parallel chord members which are vertically spaced apart, (b) multiple upright blocks which are longitudinally spaced apart along the lengths of said chord members and located therebetween, said blocks interconnecting the chord members, (c) and multiple load carrying metallic webs in spaces between the blocks, each web having flat ends, one of which is located between the upper end of a block and the lower side of the upper chord member, and the other of which is located between the lower end of another block and the upper side of the lower chord member, said other end located closer to the center of the truss than said one end, (d) successive webs in a direction away from the center of the truss having increasing thickness, (e) and including nail type fasteners driven through the chord members, then through said web flat ends, and then endwise into said blocks, the number of said fasteners driven through said flat ends increasing as the thickness of the flat ends increases for successive webs in a direction away from the center of the truss.

2. The combination of claim 1 wherein each web has angled main extent between said opposite flat ends thereof.

3. The combination of claim 1 wherein the fasteners comprise nails.

4. The combination of claim 1 wherein the blocks have approximately the same length.

5. The combination of claim 1 wherein the gage thickness of said successive webs increases by about 2 gauge.

6. The combination of claim 5 wherein the overall width of each web is $W_1$, the overall width of each chord member is $W_2$, and the ratio $W_1/W_2$ is between 0.75 and 1.00.

7. The combination of claim 1 wherein the blocks and chords consist of wood.

8. The combination of claim 1 including an elongated flat metallic reinforcement strip retained by adhesive adjacent the side of the lower chord member which faces the upper chord member.

9. The combination of claim 8 wherein said strip is located between said lower chord member side and said other ends of the webs, and including fasteners driven through the chord members, then through said elongated flat metallic strip, then through said other ends of the webs, and then endwise into said blocks.

10. The combination of claim 1 wherein said flat ends include portions which project free of the blocks, and including other nail type fasteners projecting through said flat end portions and into the associated chord member.

11. The combination of claim 10 wherein said other fasteners are shorter than said first mentioned fasteners.

12. The combination of claim 10 wherein said one flat end of the web closest the end of the truss is folded against the end of the upper chord member and nailed thereto.

* * * * *